US008375869B2

(12) United States Patent
Mayer

(10) Patent No.: US 8,375,869 B2
(45) Date of Patent: Feb. 19, 2013

(54) CRASH-RESISTANT FRONT APRON FOR A RAIL VEHICLE

(75) Inventor: Wilhelm Mayer, Gänserndorf (AT)

(73) Assignee: Siemens AG Österreich, Vienna (AT)

( * ) Notice: Subject to any disclaimer, the term of this patent is extended or adjusted under 35 U.S.C. 154(b) by 209 days.

(21) Appl. No.: 12/921,405

(22) PCT Filed: Nov. 17, 2008

(86) PCT No.: PCT/EP2008/065649

§ 371 (c)(1),
(2), (4) Date: Sep. 8, 2010

(87) PCT Pub. No.: WO2009/112095

PCT Pub. Date: Sep. 17, 2009

(65) Prior Publication Data

US 2011/0011302 A1 Jan. 20, 2011

(30) Foreign Application Priority Data

Mar. 12, 2008 (AT) ..... A 389/2008

(51) Int. Cl.

| | |
|---|---|
| ***B61D 15/06*** | (2006.01) |
| ***B60R 19/26*** | (2006.01) |
| ***B62D 33/00*** | (2006.01) |

(52) U.S. Cl. ..... 105/392.5; 293/132; 296/181.1

(58) Field of Classification Search ..... 105/392.5, 105/396, 413, 418, 419, 421, 456; 293/38, 293/129, 132, 133, 135; 296/181.1, 181.2, 296/181.7, 1.04

See application file for complete search history.

(56) References Cited

U.S. PATENT DOCUMENTS

| | | | | |
|---|---|---|---|---|
| 6,158,356 | A * | 12/2000 | Hachet et al. | 105/392.5 |
| 6,196,135 | B1 * | 3/2001 | Kashima et al. | 105/392.5 |
| 6,688,237 | B2 * | 2/2004 | Back et al. | 105/392.5 |
| 6,820,759 | B1 * | 11/2004 | Schindler et al. | 213/221 |
| 2007/0261592 | A1 * | 11/2007 | Mochida et al. | 105/392.5 |

FOREIGN PATENT DOCUMENTS

| | | | |
|---|---|---|---|
| DE | 2319061 | A1 | 10/1974 |
| DE | 3931171 | A1 | 4/1991 |
| DE | 4415793 | A1 | 11/1995 |
| DE | 4445182 | C1 | 12/1995 |
| DE | 19714118 | C1 | 9/1998 |
| EP | 0344394 | A1 | 12/1989 |
| EP | 0376351 | A2 | 7/1990 |
| JP | 2002096728 | A | 4/2002 |

* cited by examiner

*Primary Examiner* — Robert McCarry, Jr.

(57) ABSTRACT

A crash-resistant front apron for a rail vehicle is provided. The front apron includes an apron cover, a first support part supporting the apron cover, a second support part attached to a frame of the rail vehicle and a friction coupling release mechanism which connects the first support part to the second support part by a friction connection. In the event of a crash of the rail vehicle, in which a collision force acts on the front apron cover causing a torsion of the first support part relative to the second support part, the friction coupling release mechanism releases the friction connection.

20 Claims, 7 Drawing Sheets

CRASH-RESISTANT FRONT APRON FOR A RAIL VEHICLE

CROSS REFERENCE TO RELATED APPLICATIONS

This application is the US National Stage of International Application No. PCT/EP2008/065649 filed Nov. 17, 2008, and claims the benefit thereof. The International Application claims the benefit of Austrian Application No. A389/2008 AT filed Mar. 12, 2008. All of the applications are incorporated by reference herein in their entirety.

FIELD OF INVENTION

The invention relates to a crash-resistant front apron for a rail vehicle having an apron cover which is attached by means of supports to the shell of the rail vehicle.

BACKGROUND OF INVENTION

Cladding and cover elements made from plastic are used for the outer contour of modern designs of high-speed rail vehicles, with the form of said elements, especially if they are arranged in the front area of the cab, being predetermined by the aerodynamics, but also by the design. On the side walls of the front side, especially in the area of the front end, these cladding and cover elements are taken down close to the terrain in the form of an apron. These cover elements, also referred to as front aprons, are attached by a support apparatus to the base of the rail vehicle body. The base of the rail vehicle body is referred to for short as the shell below.

A rail vehicle with a mid-buffer coupling is known from DE 44 45 182 C1 in which front aprons are attached to the cab of the vehicle in the front area to the side by an articulated joint in each case. The articulated hinge is arranged at an end of the apron facing away from the front end. When the coupling block executes a lateral hinging movement as the vehicle is negotiating a curve these aprons are folded laterally outwards so that space is left for the hinging movement of the coupling block. When the coupling block assumes its central position again when the vehicle is traveling in a straight line, springs ensure that the hinge springs back again so that the outer contour of the vehicle profile is closed off flush again.

To an increasing degree however plastic is not only used for cover elements but also for manufacturing the shell. The cab of a modern rail vehicle can be manufactured in its entirety as a self-supporting plastic structure. For reasons of rigidity the plastic is reinforced with fibers. Usually glass reinforced plastic (GRP) is used for the cab.

The necessary rigidity of a cab made of GRP is defined in accordance with the relevant standards. The disadvantage incurred by the construction from GRP and the free form of this component that this allows is the complicated repair entailed even for slight damage.

The maintenance of a rail vehicle made from GRP requires—compared to maintenance work on a metal structure—a longer repair time and is also complicated and expensive.

SUMMARY OF INVENTION

An object of the present invention is to specify a crash-resistant front apron for a rail vehicle which can be attached to a self-supporting plastic structure, so that in the event of a collision the plastic structure is not damaged if possible.

This object is achieved by a crash-resistant front apron according to the independent claim. Advantageous embodiments are defined in the dependent claims.

The invention proposes a front apron for which, in the event of a crash, the front apron along with a part of the support apparatus are simply thrown aside so that the flow of force to the anchorage to the shell is interrupted. The throwing aside is undertaken so that the impact energy cannot impart any damage onto the plastic structure of the vehicle cab. In other words, only a comparatively much smaller non-critical component of the impact energy reaches the support structure of the vehicle cab. The throwing aside is effected by a friction coupling release mechanism which is disposed between a first and a second support part. The constructive design of the friction coupling release mechanism enables the proportion of impact energy transferred to be predetermined. Especially when the cab is made from GRP this is of particular advantage since complicated and expensive repair work is avoided. It can be that after an accident the front apron cover is so heavily damaged that it can no longer be used but the anchorage on the self-supporting structure of the vehicle cab remains undamaged.

An arrangement is preferred in which the support apparatus is arranged on a side of the front apron facing away from the front end. As already mentioned at the start this arrangement corresponds to the previously normal arrangement of the support apparatus for a hingeable front apron. The advantage is produced especially by the fact that, in the event of upgrading, the support apparatus previously employed can simply be replaced by the inventive two-part version of the support along with friction coupling release mechanism. The costs of upgrading a rail vehicle with a crash-resistant front apron are low.

It can be constructively useful for the first support part, the second support part along with the intermediate friction coupling and release mechanism to be disposed along a vertical axis and for this arrangement to be attached hanging down from the bottom of the shell.

To achieve a release threshold of the friction coupling release mechanism which is as defined as possible a construction is advantageous in which the torsion of the first support part is directed into the other, second support part, preferably by a guide pin in a corresponding receptacle.

In a simple version the friction coupling release mechanism can have coupling flanges at which the friction forces can be very well calculated. This means that, in the event of a crash, a predetermined pressure of the coupling flanges, where necessary also by a corresponding embodiment of the roughness of the friction surfaces, enables the release threshold to be predetermined constructively such that the separation between the two support parts is certain to occur so that the plastic shell structure of the cab will not be damaged. At the same time it can be ensured that during an accident-free journey, in which the friction force connection is to be held as stably as possible, the front apron does not work loose.

Advantageously the pressure means are embodied so that the pressure force can be adjusted. This enables the release threshold to be predetermined ex-works or to be adjusted if necessary during maintenance work.

A simple construction can be designed so that slots and holes are embodied in each case on the coupling flanges. In trouble-free normal operation a slot and a hole are opposite one another in each case. A pressure means, for example a screw, is pushed through each slot with assigned hole and is provided with a nut at its end. This predetermines in a simple manner the rotational position at which separation will occur in the event of a crash.

The slots can be embodied simply as elongated holes which are milled into the surround contour.

The application of the pressure force can also be supported or effected by a spring element, for example a spiral spring or a disk spring.

A useful form of embodiment can be characterized by return means known per se, which return the front apron cover from the hinged-out position into a position flush with the outer skin, being used in the event of a crash to create the torque from the collision force which effects the desired separation process between the support parts. Gas pressure springs known per se are suitable for this.

The return means can be a spring means which, in the event of a crash however, viewed in the longitudinal extent, acts in one direction as a rigid body and in this direction transfers either a tension force or a compression force to the first support part.

It has been shown that in the event of a crash a reliable separation of the two support parts can especially be achieved if the friction surfaces towards the longitudinal axis of the rail vehicle are disposed at an angle of around 75% relative to the height axis of the rail vehicle.

In principle of position and the orientation of the friction surfaces is to be adapted to the envisaged accident scenario. For this reason no generally valid preferred variant can be specified.

In order to guarantee the most even friction possible between the friction surfaces of the coupling flanges over a long period of operation it can be useful for corrosion on the friction surfaces to be counteracted by an appropriate coating.

BRIEF DESCRIPTION OF THE DRAWINGS

For a further explanation of the invention the reader is referred in the subsequent part of the description to the drawings, in which further advantageous embodiments, details and developments of the invention are to be found.

The drawings show.

DETAILED DESCRIPTION OF INVENTION

Figure 1:
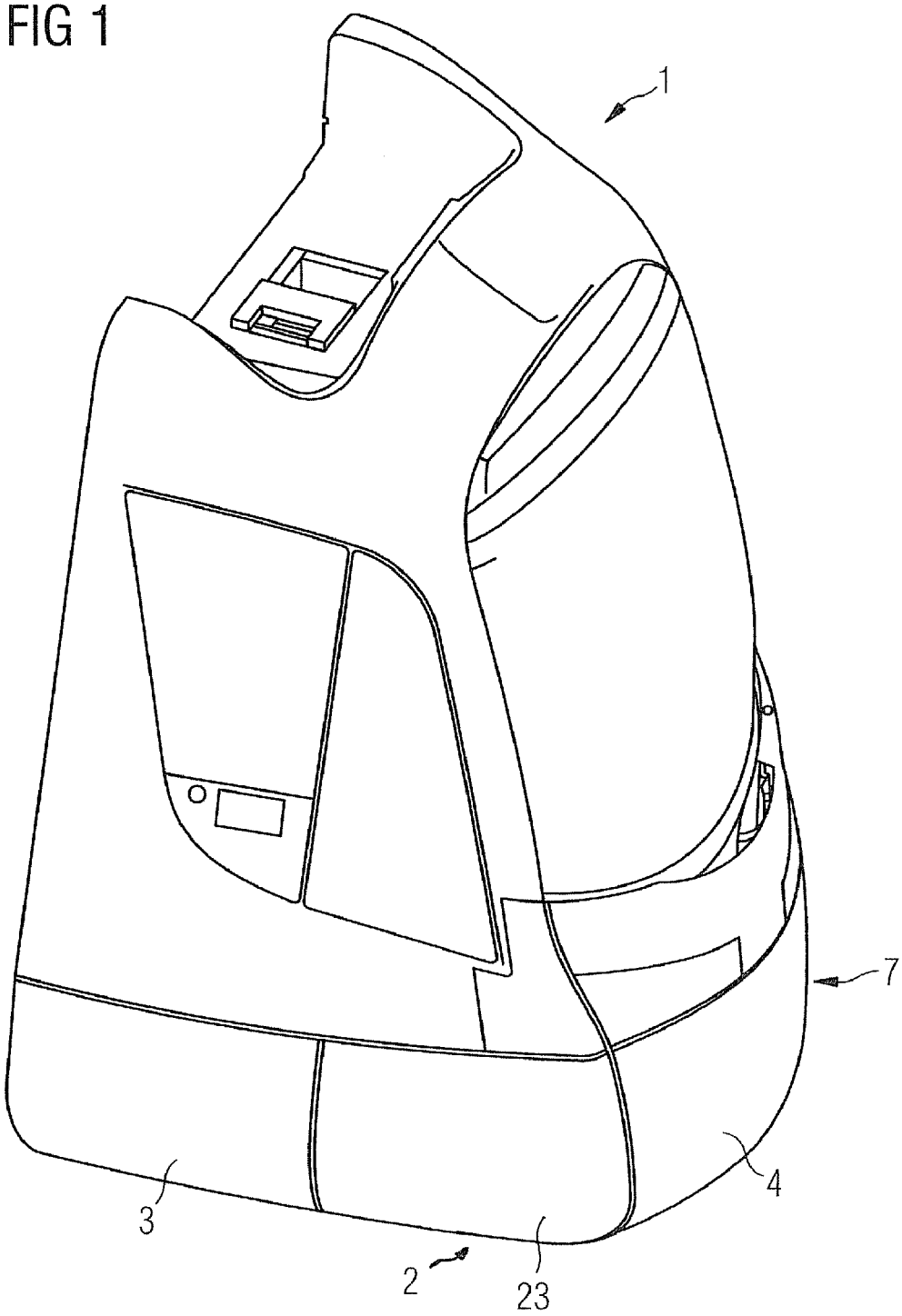
FIG. 1 a cab of a rail vehicle constructed in the new way in a three-dimensional diagram.

A three-dimensional diagram of a cab 1 of a rail vehicle can be seen in FIG. 1, the outer contour of which is covered towards the area of the rail bed by aprons 2, 3, 4. As already explained at the start, plastic is used nowadays not only in the production of the cover elements or the hingeable front apron cover 23 disposed to the side in the area of the front 7 but also in the production of the cab 1.

Figure 2:
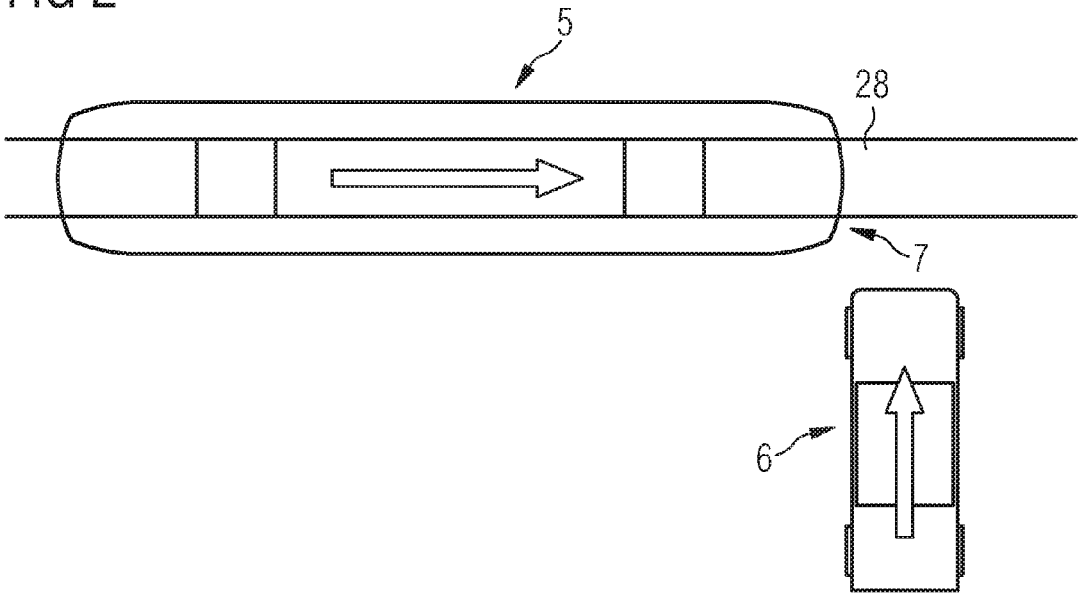
FIG. 2 a rail vehicle and an automobile in an accident scenario before a collision, viewed from above.
Figure 3:
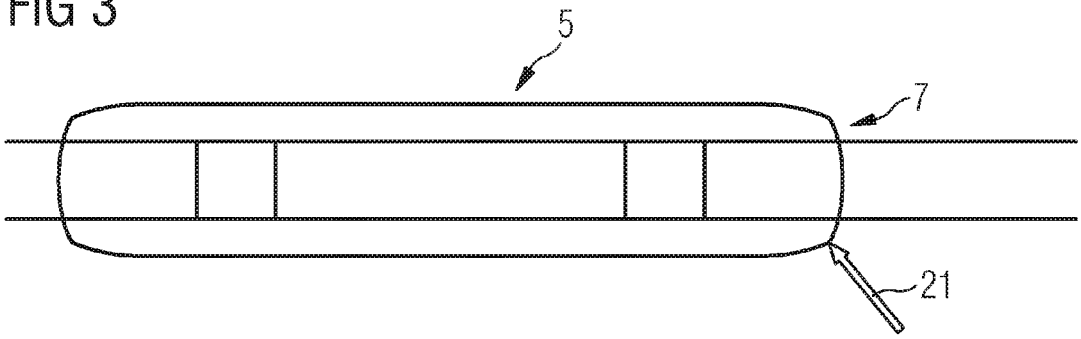
FIG. 3 a rail vehicle after a collision, with a collision force introduced at an angle from the front and a laterally deformable front apron area, in a sketch viewed from above.

The scenario of a collision between a rail vehicle 5 and an automobile is outlined in FIGS. 2 and 3. The reference character 28 and the arrow show the direction of travel of the rail vehicle 5. The force effect arising in the event of a crash (arrow 21) means that not only damage to the side front apron cover 23 can arise but also significant material damage can arise through the transfer of force from the front apron 23 to the self-supporting plastic structure of the cab 1.

Figure 4:
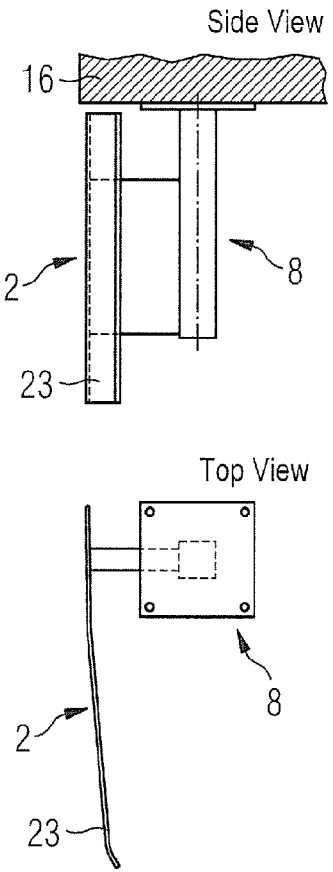
FIG 4 (Prior Art)
FIG. 4 a front apron with a support apparatus according to the prior art, shown schematically in a view from the side and from above.

In FIG. 4 the conventional attachment of the front apron 2 to the shell 16 of a rail car chassis is outlined. In the event of a collision, the collision force (acting in FIG. 4 from the left on the front apron cover 23) can be transferred without attenuation and weakening through the rigid construction of the support apparatus 8 to the shell 16.

Figure 5A:
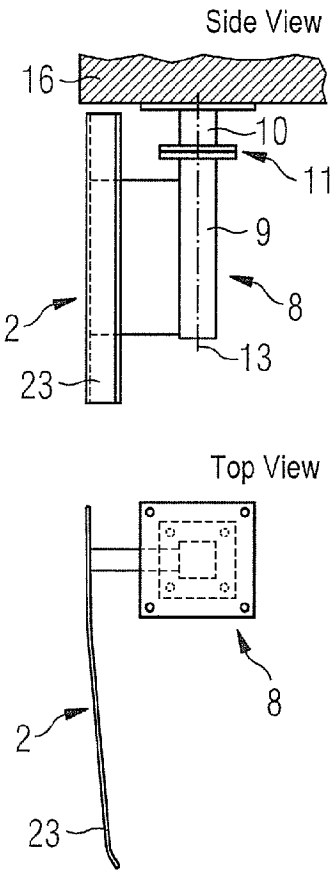
FIG. 5*a* a sketch of an inventive front apron without the effect of a collision force in a view from the side and from above.
Figure 5B:
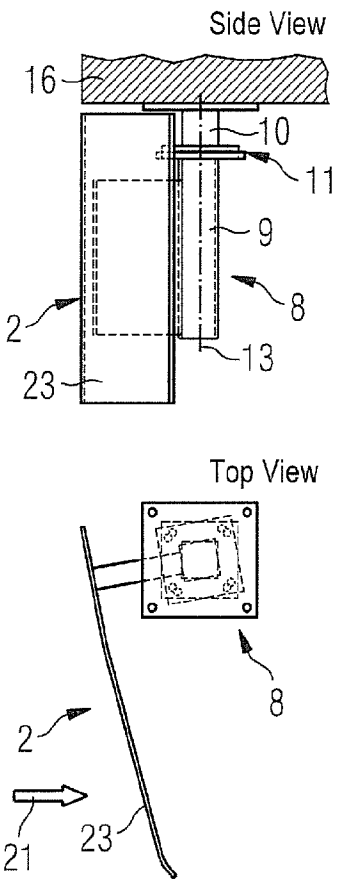
FIG. 5*b* the inventive front apron as depicted in FIG. 5*a* when acted upon by a collision force, in a view from the side and from above.
Figure 5C:
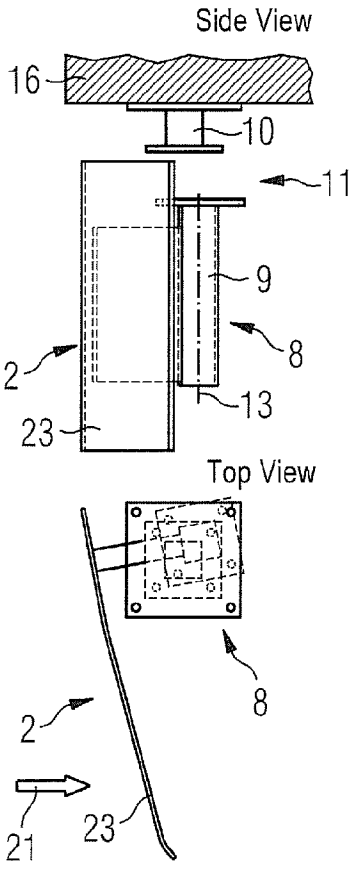
FIG. 5*c* the inventive front apron as depicted in FIG. 5*a* in the state after the collision, in which the support parts are separated, in a view from the side and from above.

FIGS. 5*a*, 5*b* and 5*c* on the other hand show a schematic diagram of the crash-resistant inventive embodiment of the front apron 2. It prevents in permissibly high impact loading being transferred to the structure of the shell 16 in the event of a crash.

FIG. 5*a* shows the no-loading case. The crash-resistant front apron 2 essentially consists of a support apparatus 8 comprising a first support part 9 to which a front apron, 23 is attached and a second support part 10 which is attached to the shell 16 or to the rail vehicle chassis respectively. Between the first support part 9 and the second support part 10 is arranged a friction coupling release mechanism 11.

In FIG. 5*b* the surface force acting in the event of a crash on the front apron cover 23 is indicated by an arrow 21. A torque around the axis 13 acts on the first support part 9. When the frictional adhesion in the friction coupling release mechanism 11 is overcome, the first support part 9 twists in relation to the solidly mounted second support part 10.

As outlined in FIG. 5*c*, in the event of a crash, the first support part 9 along with the front apron cover 23 falls off. This means that no connection exists any longer between the application of force 21 to the front apron covered 23 and the shell 16. And impermissibly high loading of the anchoring of the support apparatus 8 in the shell 16 is avoided.

Figure 6A:
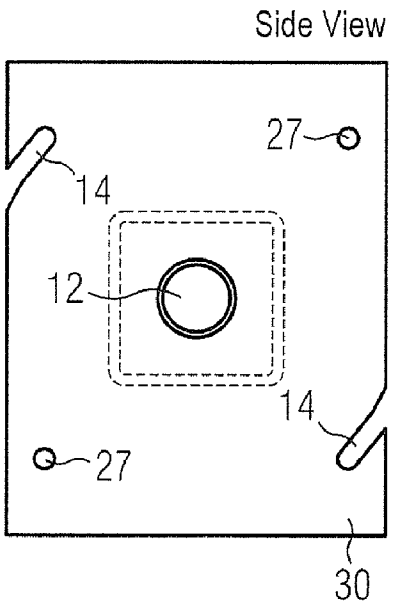
FIG. 6*a* a view from the side and from above of the coupling flange of the first support part.
Figure 6A:
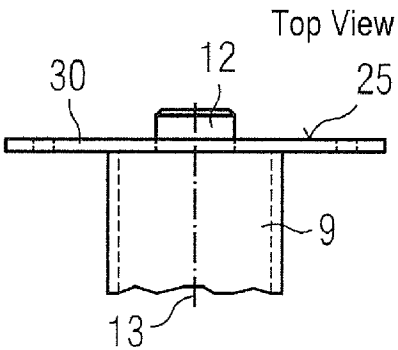
Figure 6B:
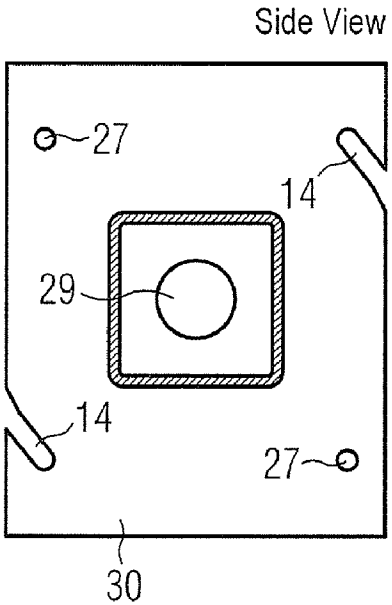
FIG. 6*b* a view from the side and from above of the coupling flange of the second support part.
Figure 6B:
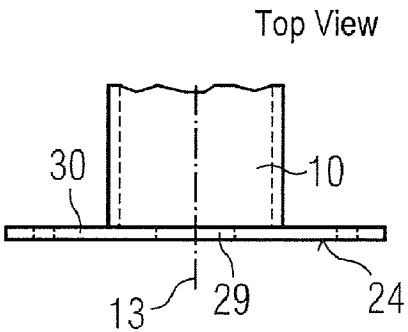
Figure 6C:
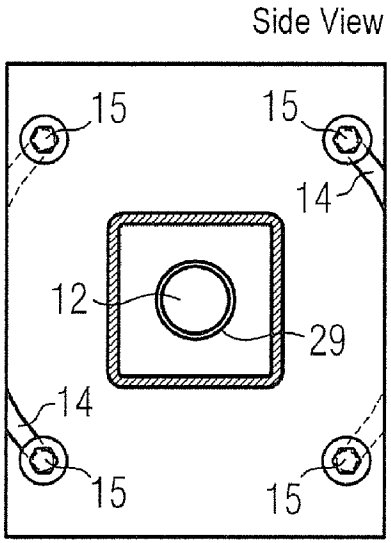
FIG. 6*c* a view from the side and from above of the coupling flange of the first and second support part in an assembled state.
Figure 6C:
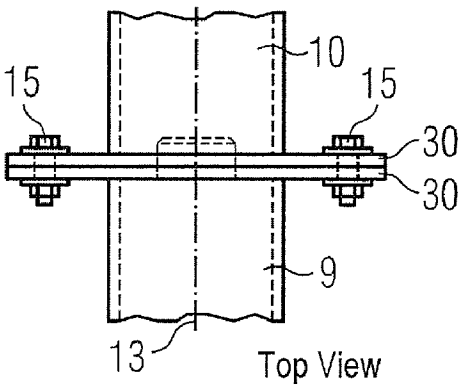

In the diagram depicted in FIGS. 6*a* and 6*b* the friction coupling flange 30 embodied on the first support part 9 or on the second support part 10 respectively is shown as a detail in a side view and in an axial overhead view respectively. The first support 9 has a guide pin 12, the second support 10 a corresponding hole 29. As can easily be seen from the respective overhead view, each of these coupling flanges 30 has slots 14 which extend from the outer contour in the form of an elongated hole into the flange. In an assembled state, which is shown in FIG. 6*c*, the two coupling flanges 30 are held together by a friction fit by screws and nuts 15 which are pushed into a slot 14 or into a hole 27 in each case. The constructive embodiment of the friction surfaces 25 or 24 respectively and the pressure created by the screw connection 15 enables a defined "shear torque" to be set.

Figure 7:
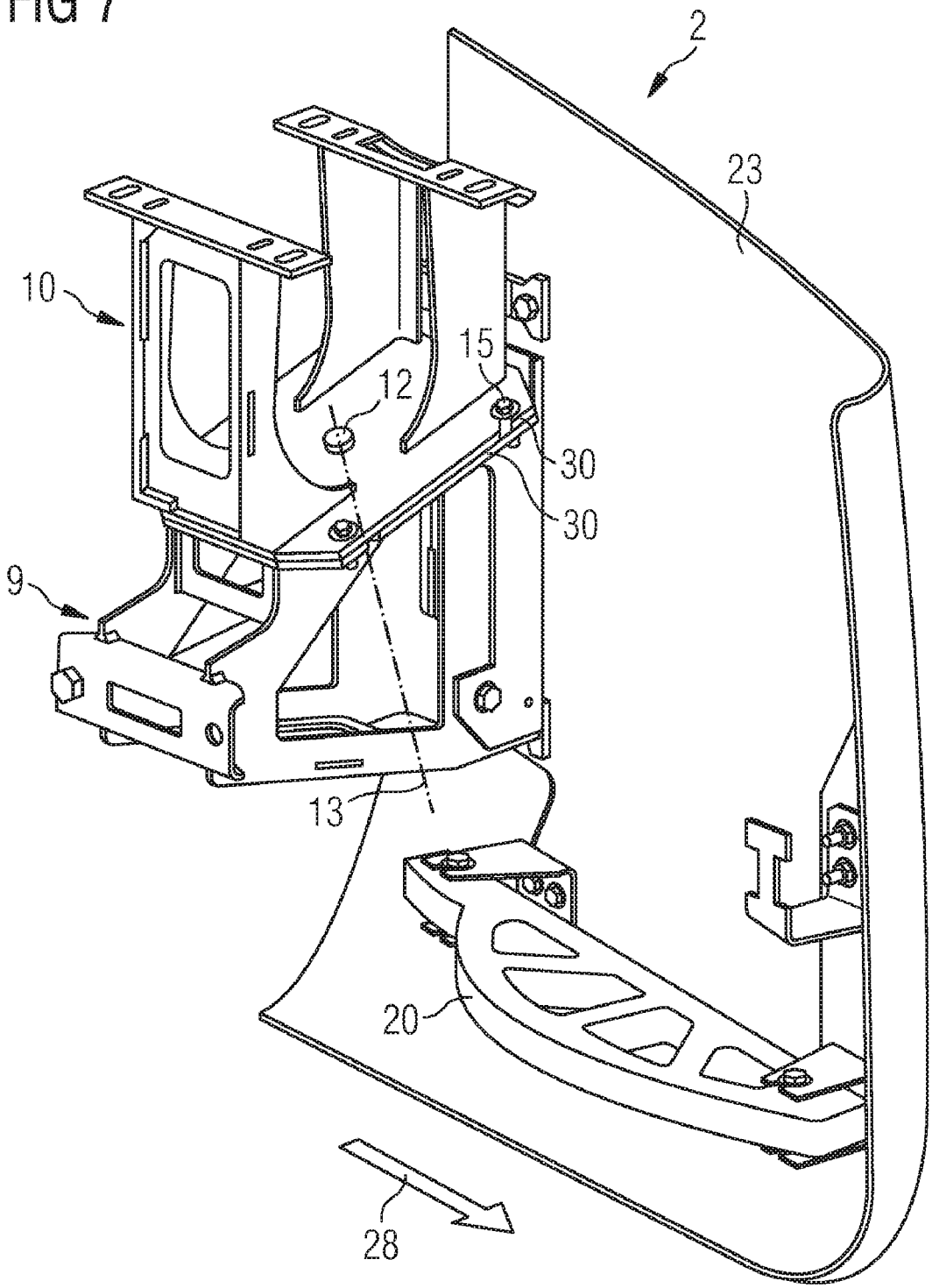
FIG. 7 an exemplary embodiment of the inventive front apron in a three-dimensional diagram seen from the front end of the rail vehicle.
Figure 8:
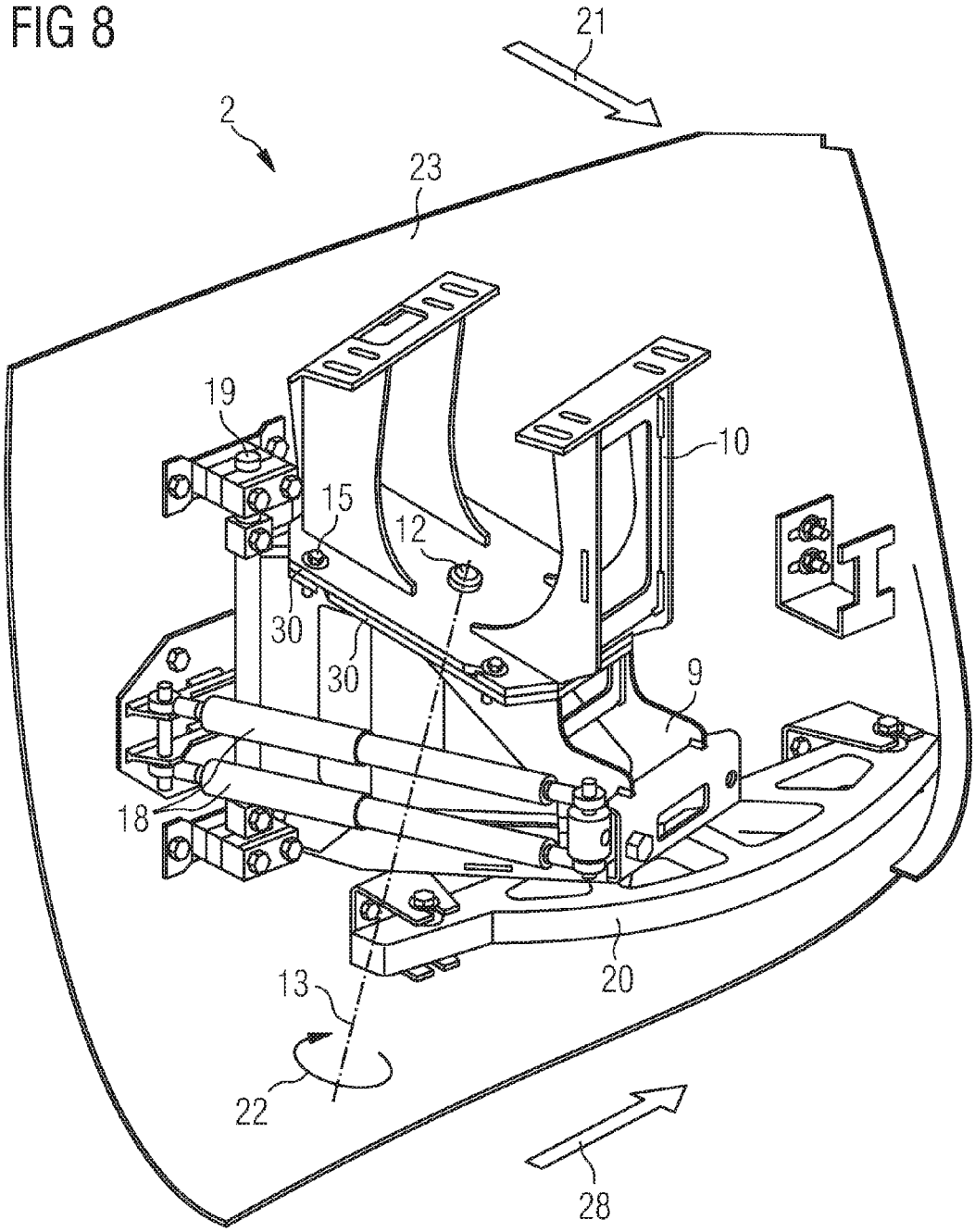
FIG. 8 the inventive front apron as depicted in FIG. 7, viewed in the direction of the front end.

In FIG. 7 and in FIG. 8 a lateral front apron 2 arranged on the left in the direction of the front end is to be seen in accordance with an exemplary embodiment of the present invention in a prospective view in each case.

FIG. 7 shows the inventive front apron 2 seen from the center of the vehicle against the direction of the front end 28. The lower support part 9 is attached by screws to the inner side of the front apron cover 23. Mounted by four screws 15 on this first support part 9 is the second support part 10. The second support part 10 is screwed onto the shell 16 (not shown in FIG. 7) of the cab. Below the support apparatus 9, 10 a cam contour 20 can be seen which is likewise attached to the inside of the front apron cover 23. The coupling block (not shown in FIG. 7) presses on this cam contour 20 when the vehicle is negotiating a curve. As explained at the start, this causes the front apron cover 23, which is articulated on the first support part 9 (see hinge axis 19 in FIG. 8), to be hinged outwards like a wing and makes the space for a coupling block not shown in FIGS. 7 and 8.

FIG. 8 likewise shows a view of the inner surface of the front apron cover 23, here seen at an angle from the left in the direction 28 of the front end. The hinged-out front apron cover 23 is brought back by two pneumatic springs 18. These pneumatic springs 18 are articulated at their one end on the first support part 9 and with their other end on the inner surface of the front apron cover 23. Their spring pressure causes the exposed front apron cover 23 to swing back. If the pneumatic springs 18 are located in a position in which the front apron cover 23 is flush with the outer contour, the pneumatic springs 18 have reached their maximum length. Under tensile stress they act in this operating position as rigid bodies. This means that, in the event of a crash, the pneumatic springs 18 under tensile stress (in a collision the surface force 21 acts on the front apron cover 23) which are attached by an articulated joint to the lower support 9, create a torque around the axis 13 (the direction of the torque is indicated in FIG. 8 by the arrow 22). As soon as this torque 22 exceeds the adhesion friction between the friction surfaces 24, 25 of the coupling flanges 30, the first support part 9 starts to twist in relation to the second support part 10 around the axis 13. This rotational movement around the axis 13 is guided by the guide pins 12 and the corresponding receptacle in the opposing part. As soon as the support 9 has reached a rotational position predetermined by the length of the slots (se FIGS. 9 and 10) in relation to the support mounted in a fixed position on the chassis in which the screws 15 are turned out of the slots 14, the connection between the first support part 9 and the second support part 10 is released. Thus separates the front apron cover 23 from the shell 16 however. The crash-resistant front apron 2 falls away. The separation mechanism is designed so that, in the event of an impact, it separates the flow of force early enough for the GRP section to remain undamaged.

Figure 9:
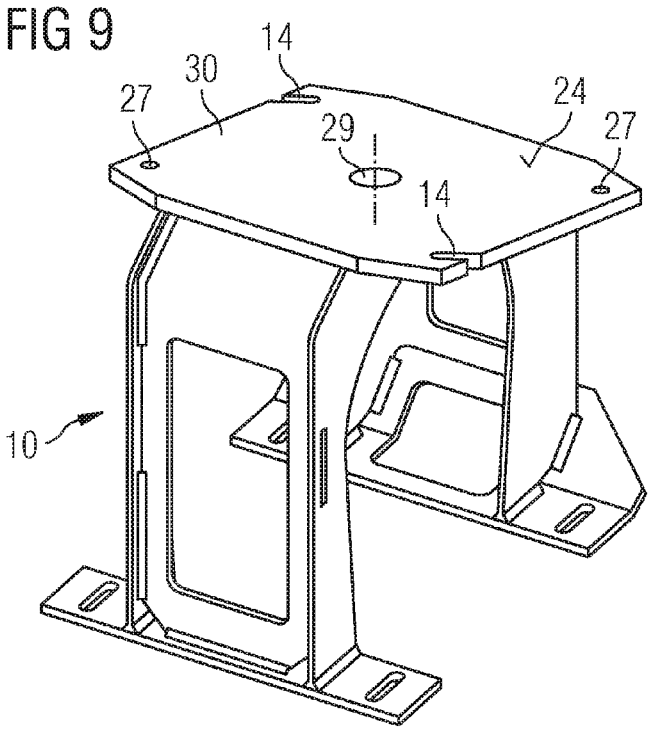
FIG. 9 a three-dimensional view of the second support part.
Figure 10:
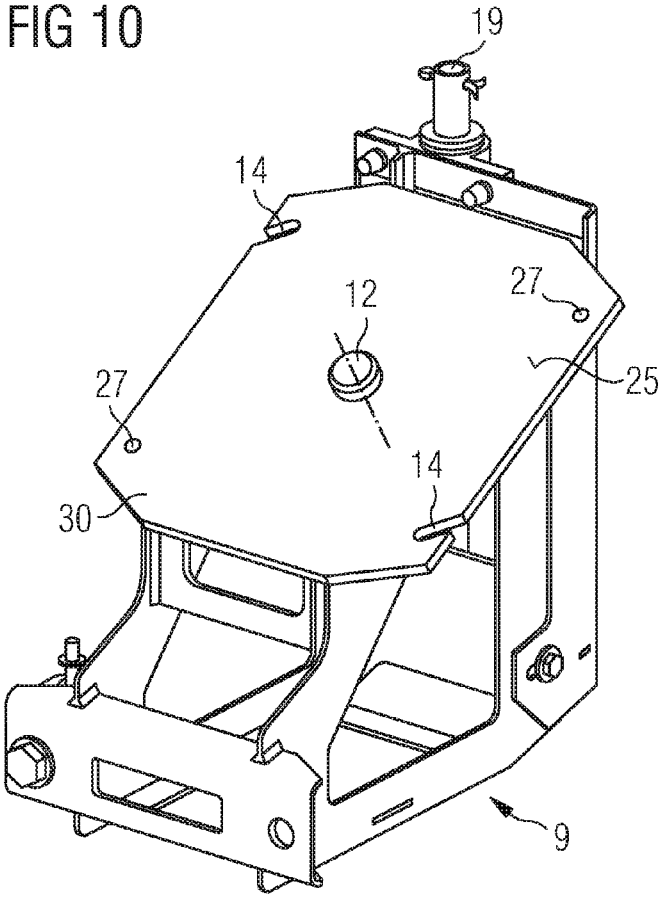
FIG. 10 a three-dimensional view of the first support part.

In a three-dimensional individual diagram the second support part can be seen in FIG. 9 and the first support part in FIG. 10 in an enlarged perspective view. During assembly the second support part 10 will be placed onto the first support part 9 rotated by 180° so that the guide pin 12 engages in the corresponding recess 29 and the two friction surfaces 24 and 25 rest against one another. The pressure force between the friction surfaces 24, 25 is, as already explained above, effected by screws and nuts 15 (FIGS. 7 and 8), which are each pushed through one of the four holes 27 or through one of the four corresponding slots 14 respectively. Embodied in each coupling flange 13 are two holes 27 and two slots 14 respectively. The slots 14 are designed as elongated holes which extend along an arc and are open towards the outer contour of the coupling flange 30. The length of the slots predetermines the angle of rotation which is necessary in the event of a crash to separate the two parts 9 and 10. A defined "shear torque" can be achieved as already stated by the constructive design of the friction surfaces 24, 25 and by the tightening torque of the screw connection. The hinge axis 19 on which the front apron cover 23 is hinged can be seen very well in FIG. 10.

FIGS. 7 and 8 show a version of the invention in which the return means 18, which in the event of a crash transfers the torque to the first support part, seen in the direction of the front, is disposed before the support parts 9, 10. It is further also conceivable for the return means 18, seen in the direction of the front 28, to be disposed after the support parts 9, 10; in this case the spring means 18 act as compression springs when the front apron cover 23 is extended. In order here too in the event of a crash to translate the collision force 21 into a torque in accordance with the arrow 22, the return means 18 are created here so that, in their position in which the front apron cover closes flush with the outer skin, they cannot be pushed together any further, i.e. they act here in the event of a crash not as tension struts but as compression struts. As a result with this variant a torque in accordance with arrow 22 is created in the event of a crash.

Compared to a shear pin or another intended breakpoint, the friction coupling release mechanism in 11 allows the release thresholds to be set relatively closely above the maximum operating loading at which the front apron cover is still to be held stably on the chassis. In this way the overloading of the structure lying behind it is minimized.

A significant advantage of the invention results from the fact that the coalition forces acting in the event of a crash on the rail vehicle chassis of a self-supporting cab are easy to estimate. This especially enables C rails on which in the usual way the supports of the front apron are attached by means of screws to be very well protected. To remedy damage it can be sufficient simply to replace the damaged front apron cover. The repair and idle time of the rail vehicle can be kept small. Complicated repairs and high repair costs to the chassis of the rail vehicle can be avoided.

A further advantage is to be seen in the fact that rail vehicles already in operation can be retrofitted with the inventive front apron at little expense.

The invention claimed is:

1. A crash-resistant front apron for a rail vehicle, comprising:

a front apron cover;

a first support part which holds the front apron cover;

a second support part which is fixed to a frame of a shell of the rail vehicle; and a friction coupling release mechanism which connects the first support part to the second support part via a friction connection, and which releases the friction connection in the event of a crash of the rail vehicle which causes a twisting of the first support part in relation to the second support part based upon a collision force acting on the front apron cover.

2. The front apron as claimed in claim 1, wherein the first support part, the second support part and the friction coupling release mechanism are arranged at an end of the front apron cover positioned opposite the front end of the rail vehicle.

3. The front apron as claimed in claim 2, wherein the first support part, the second support part and the friction coupling release mechanism are arranged on an underside of the shell hanging along an essentially vertical axis.

4. The front apron as claimed in claim 3, wherein the twisting of the first support part in relation to the second part is guided by a guide pin and a corresponding recess, and wherein the guide pin or the recess are embodied either on the first support part or on the second support part.

5. The front apron as claimed in claim 1, wherein the first support part, the second support part and the friction coupling release mechanism are arranged on an underside of the shell hanging along an essentially vertical axis.

6. The front apron as claimed in claim 5, wherein the twisting of the first support part in relation to the second part is guided by a guide pin and a corresponding recess, and wherein the guide pin or the recess are embodied either on the first support part or on the second support part.

7. The front apron as claimed in claim 1, wherein the friction coupling release mechanism comprises coupling flanges with friction surfaces facing towards each other, the friction surfaces being pressed against each other by pressure means, and wherein the friction surfaces are separated from each other in the event of a crash of the rail vehicle.

8. The front apron as claimed in claim 7, wherein a pressure force is adjustable by the pressure means.

9. The front apron as claimed in claim 8, wherein the coupling flanges comprise slots and holes, and wherein the slots and holes are located opposite one another in pairs and one pressure means is pushed through a slot and hole assigned opposite to the slot.

10. The front apron as claimed in claim 9, wherein the slots are embodied as elongated holes which extend in the form of an arc to an outer contour of one coupling flange and each pressure means is a screw-nut connection.

11. The front apron as claimed in claim 7, wherein the coupling flanges comprise slots and holes, and wherein the slots and holes are located opposite one another in pairs and one pressure means is pushed through a slot and a hole assigned opposite to the slot.

12. The front apron as claimed in claim 11, wherein the slots are embodied as elongated holes which extend in the form of an arc to an outer contour of one coupling flange and each pressure means is a screw-nut connection.

13. The front apron as claimed in claim 7, wherein the pressure means comprise a pre-tensioned spring element.

14. The front apron as claimed in claim 7, wherein the friction surfaces in an assembled state lie in a plane which assumes an angle of around 75 degrees in relation to a vertical axis of the rail vehicle.

15. The front apron as claimed in claim 7, wherein the friction surfaces are coated with a layer resistant to corrosion.

16. The front apron as claimed in claim 1, wherein the front apron cover is articulated on the first support part and is able to be hinged in a horizontal direction, wherein return means are provided which pull the front apron cover back from a hinged-out position into a position in which an outer contour of the rail vehicle is closed off in a flush configuration, and wherein the return means transfer the collision force acting in the event of a crash on the front apron cover to the first support part and effect the twisting of the first support part in relation to the second support part.

17. The front apron as claimed in claim 16, wherein the return means are spring means, which act in the event of a crash, viewed in a lengthwise extent of the spring means, in a direction as a solid body, and either transfer a tension force or a compression force to the first support part.

18. The front apron as claimed in claim 1, wherein the second support part is attached to the shell by screws, the screws comprising channel nuts which are guided in profile bars embodied in a C-shape, the profile bars being attached to the lower side of the shell by an adhesive bond.

19. The front apron as claimed in claim 1, wherein the first support part and the second support part are made of metal.

20. A cab of a rail vehicle with a crash-resistant front apron, the front apron comprising:

a front apron cover;

a first support part which holds the front apron cover;

a second support part which is fixed to a frame of a shell of the rail vehicle; and a friction coupling release mechanism which connects the first support part to the second support part via a friction connection, and which releases the friction connection in the event of a crash of the rail vehicle which causes a twisting of the first support part in relation to the second support part based upon a collision force acting on the front apron cover.

* * * * *